US012660954B2

(12) United States Patent
Taylor

(10) Patent No.: US 12,660,954 B2
(45) Date of Patent: Jun. 23, 2026

(54) TABLE EDGE HAT HANGER

(71) Applicant: James Michael Taylor, London (CA)

(72) Inventor: James Michael Taylor, London (CA)

( * ) Notice: Subject to any disclaimer, the term of this patent is extended or adjusted under 35 U.S.C. 154(b) by 0 days.

(21) Appl. No.: 18/667,551

(22) Filed: May 17, 2024

(65) Prior Publication Data

US 2024/0389777 A1 Nov. 28, 2024

Related U.S. Application Data

(60) Provisional application No. 63/469,296, filed on May 26, 2023.

(51) Int. Cl.
*A47G 25/10* (2006.01)
*A47F 7/06* (2006.01)

(52) U.S. Cl.
CPC ..... *A47G 25/10* (2013.01); *A47F 7/06* (2013.01)

(58) Field of Classification Search
CPC ... A47G 25/10; A47F 7/19; A47F 7/24; A47F 7/06
See application file for complete search history.

(56) References Cited

U.S. PATENT DOCUMENTS 350,807 A * 10/1886 Clark ..... A47G 25/10 211/32
412,074 A * 10/1889 Darcy ..... A47G 25/10 248/214
547,828 A * 10/1895 Weicher ..... A47G 25/10 211/30
723,193 A * 3/1903 Bernard ..... A47G 25/10 248/216.4
740,734 A * 10/1903 Bishop ..... A47G 25/10 24/348
980,162 A * 12/1910 Meyer ..... B25B 5/06 248/229.23
1,403,004 A * 1/1922 Beckers ..... A47G 25/10 248/229.16
1,501,807 A * 7/1924 Petschel ..... A47G 25/10 211/32
1,570,451 A * 1/1926 Simoneau ..... A47G 25/10 248/214
1,751,198 A * 3/1930 Franck ..... A47G 29/083 248/215
2,064,133 A * 12/1936 Von Schroeder .... A47G 29/083 33/8
2,295,370 A * 9/1942 Tritt ..... A47G 25/10 24/336

(Continued)

FOREIGN PATENT DOCUMENTS

DE 548758 C * 4/1932
FR 698711 A * 2/1931

*Primary Examiner* — Stanton L Krycinski
(74) *Attorney, Agent, or Firm* — Capehart Law Firm

(57) ABSTRACT

A portable hat hanger is disclosed herein. According to some versions, the portable hat hanger includes a first portion, a second portion pivotably connected to the first portion and a hanger portion pivotably connected to the second portion. The portable hat hanger is preferably foldable, compact and lightweight; therefore, easily fitting into a pocket, purse or handbag to enable easy portability thereof. The portable hat hanger solves the problem of where to place or store a hat when temporarily removed, such as when dining, in a meeting, etc.

14 Claims, 8 Drawing Sheets

(56) References Cited

U.S. PATENT DOCUMENTS

| | | | | | |
|---|---|---|---|---|---|
| 2,473,086 | A * | 6/1949 | Montero | A47G 29/083 | 248/340 |
| 2,630,921 | A * | 3/1953 | Stephenson | A47G 25/10 | 211/32 |
| 3,208,597 | A * | 9/1965 | Hansen | A47G 25/10 | 211/32 |
| 4,118,001 | A * | 10/1978 | Serkez | A47G 29/083 | 24/601.5 |
| 4,194,714 | A * | 3/1980 | Schultz | A47G 29/083 | 116/DIG. 1 |
| 4,210,302 | A * | 7/1980 | Serkez | F16M 13/022 | 248/308 |
| D314,358 | S * | 2/1991 | Holzworth | D6/315 | |
| 5,094,417 | A * | 3/1992 | Creed | A47G 29/083 | 248/339 |
| 5,772,049 | A * | 6/1998 | Randone | A47F 7/06 | 211/32 |
| 6,349,862 | B1 * | 2/2002 | Smith | A47G 25/10 | 223/24 |
| 7,828,258 | B2 * | 11/2010 | Shigio | A47G 29/083 | 223/120 |
| 10,413,047 | B2 * | 9/2019 | Albanese | A44B 99/00 | |
| 10,786,077 | B2 * | 9/2020 | Dudley | A47B 61/003 | |
| 11,122,924 | B2 * | 9/2021 | Williams, Jr. | A47F 5/0876 | |
| 12,121,170 | B2 * | 10/2024 | Morris | F16B 1/00 | |
| 2012/0280094 | A1 * | 11/2012 | Post | A47G 25/10 | 248/205.2 |
| 2013/0313387 | A1 * | 11/2013 | Ly | A47G 25/0678 | 248/205.3 |
| 2024/0423400 | A1 * | 12/2024 | Cadena | A42B 1/002 | |

* cited by examiner

TABLE EDGE HAT HANGER

CROSS-REFERENCE TO RELATED APPLICATION

The present application is related to and claims priority to U.S. Provisional Patent Application No. 63/469,296 filed May 26, 2023, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

The present invention relates generally to the field of hat holders of existing art and more specifically relates to a device for hanging a hat on a table.

A prevalent issue that many individuals face when wearing a hat outside of their home is finding a suitable place to put their hat when necessary to temporarily remove the hat. For example, whilst dining at a restaurant, the individual may wish to remove the hat but may not have a suitable place to store it. Alternatively, conventions, meetings, golf clubhouses, etc. are examples of other circumstances in which an individual may wish to remove their hat but may not have a proper storage solution.

This problem can be frustrating and inconvenient, as the individual has few solutions, all of which are inadequate and only seem to provide more problems. For example, the individual can opt to keep the hat on, but that may be uncomfortable and cumbersome. Alternatively, placing the hat on the floor may lead to damage and soiling, while placing it on the table occupies valuable space. As such, a suitable solution is desired.

SUMMARY OF THE INVENTION

In view of the foregoing disadvantages inherent in the known hat holder art, the present disclosure provides a novel table edge hat hanger. The general purpose of the present disclosure, which will be described subsequently in greater detail, is to provide a portable, compact device that is able to unfold from its folded compact position to attach, at one end, to a table; and at the opposite end, a hat can be hooked to the device. As such, the hat is conveniently held on the table.

A portable hat hanger is disclosed herein. According to one or more embodiments, the portable hat hanger may include a first portion, a second portion and a hanger portion. The first portion and the second portion may each include a distal end opposite a proximal end and may be pivotably connected together at their proximal ends such that the first portion and the second portion are able to pivot relative to each other between a folded position and an unfolded position. Further, the first portion may include a counterweight disposed about the distal end thereof configured to secure the portable hat hanger about an edge of a horizontal surface in the unfolded position.

The hanger portion may be pivotably attached about the distal end of the second portion and able to pivot between a stowed position and a hanging position relative to the second portion. The hanging position may enable a hat to be held on the hanger portion; and the counterweight in the first portion counteracts a weight of the hat held on the hanger portion.

According to another embodiment, a portable hat hanger for a table is also disclosed herein. In one or more embodiments, the portable hat hanger may include a first portion and a second portion each including an elongated body and a distal end opposite a proximal end and pivotably connected together at their proximal ends such that the first portion and the second portion are able to pivot relative to each other between a folded position and an unfolded position. In the folded position, the first portion and the second portion may be angled substantially 0 (zero) degrees relative each other; and in the unfolded position, the first portion and the second portion may be angled substantially 90 degrees relative each other. The first portion may further include a counterweight disposed about the distal end thereof, and a first non-slip material coupled to an interior surface thereof, each configured to secure the portable hat hanger about an edge of the table in the unfolded position.

A hanger portion may be pivotably attached to the distal end of the second portion and able to pivot between a stowed position and a hanging position relative to the second portion. The hanging position may include the hanger portion being at an angle of between 10 and 90 degrees relative to the second portion, thereby enabling a hat to be hooked onto on the hanger portion. An interior surface of the hanger portion may further include a second non-slip material, further securing the hat to the hanger portion. The counterweight in the first portion may counteract a weight of the hat hooked onto the hanger portion.

According to another embodiment, a portable golf cap hanger is also disclosed herein. According to one or more embodiments, the portable golf cap hanger may include the first portion, the second portion and the hanger portion as discussed above. In this embodiment, the first portion may further include a recess disposed within an exterior surface of the first portion about the distal end thereof and sized to receive a golf ball marker therein.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF FIGURES

The figures which accompany the written portion of this specification illustrate embodiments and methods of use for the present disclosure, a table edge hat hanger, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a table edge hat hanger. Generally, the table edge hat hanger may include a folding device that, when opened, rests on the edge of a table or countertop and enables a user to hang their hat on the device. The folding device is preferably compact and lightweight, easily fitting into a pocket, purse or handbag to enable easy portability thereof. As such, the table hat hanger solves the problem of where to place a hat when temporarily removed (such as when dining).

Referring now more specifically to the drawings by numerals of reference, there is shown in FIGS. 1-8, various views of a portable hat hanger 100.

Figure 1:
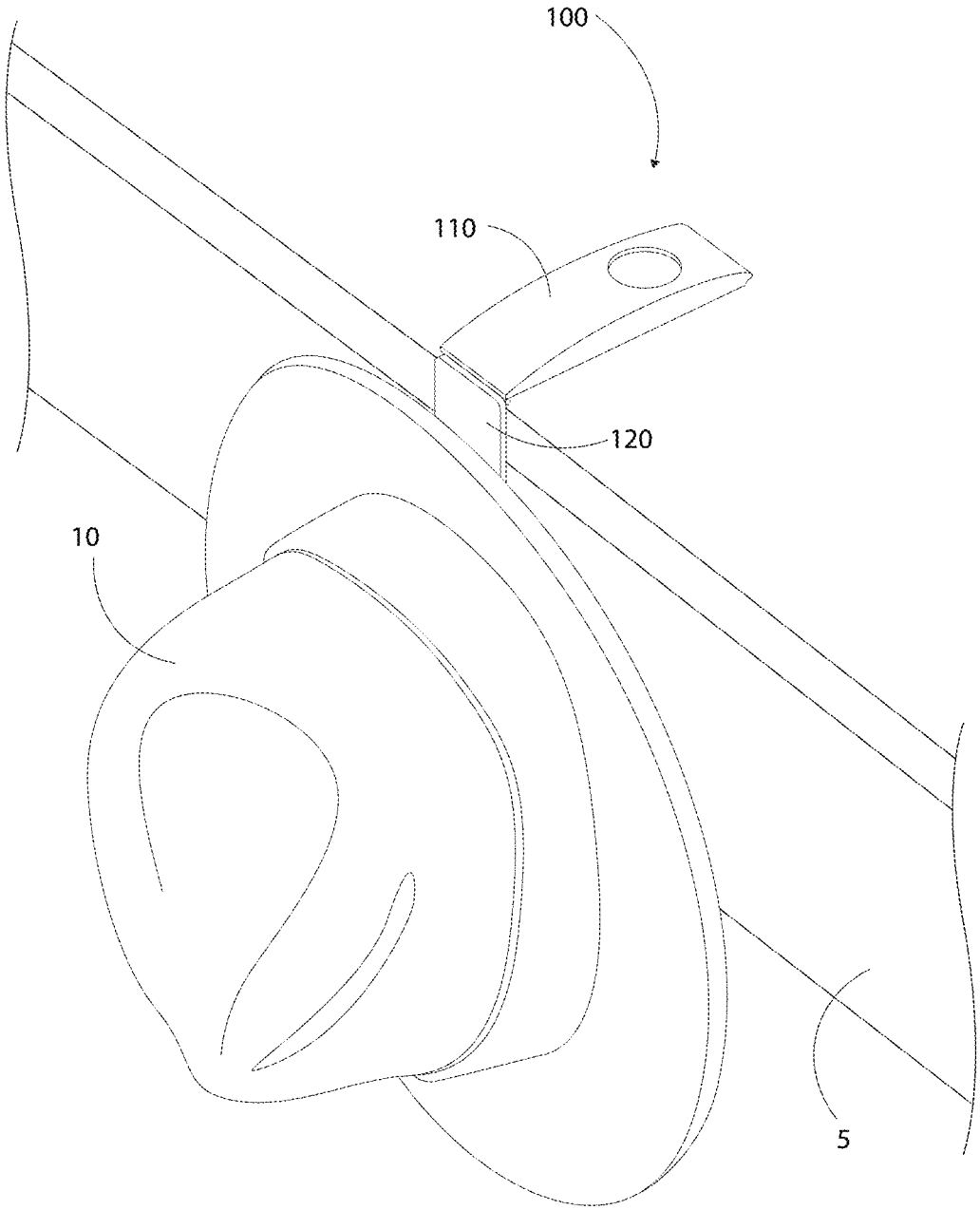
FIG. 1 is a perspective view of a portable hat hanger being used to hang a hat on a table, according to an embodiment of the disclosure.
Figure 2:
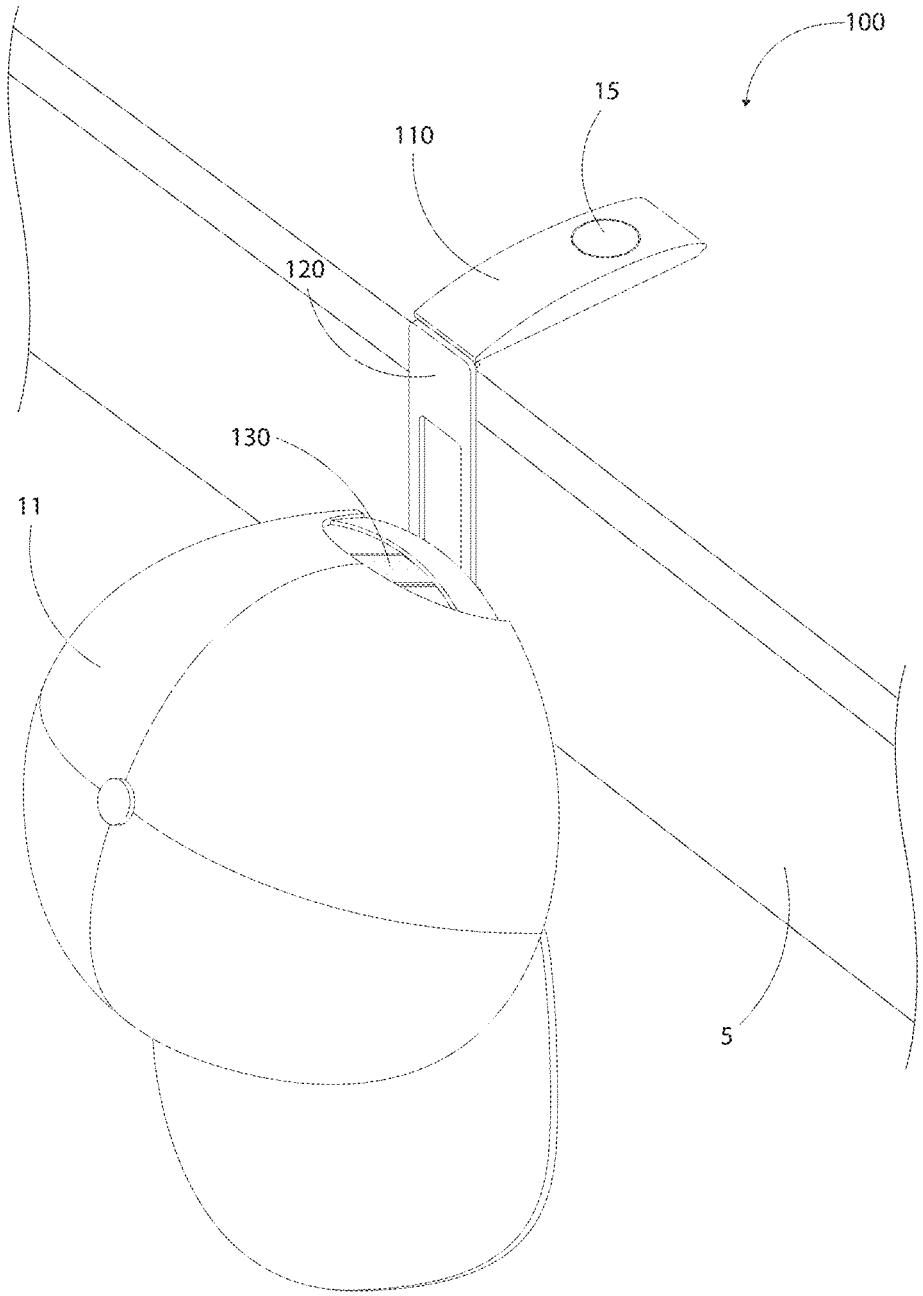
FIG. 2 is a perspective view of a portable hat hanger being used to hang a golf cap on a table, according to an embodiment of the disclosure.

Referring first to FIGS. 1-2, there are shown perspective views of the portable hat hanger 100 in use, according to one or more embodiments of the present disclosure. As shown here, the portable hat hanger 100 may be configured to attach a hat 10 to a horizontal surface, such as a table 5. The portable hat hanger 100 may be configured for use with a variety of different hats 10 of different sizes and shapes.

FIG. 1 in particular demonstrates the portable hat hanger 100 being used to hang a fedora hat 10 to a table 5. FIG. 2 demonstrates the portable hat hanger 100 being used to hang a cap 11, often worn by golfers. In some examples, the portable hat hanger 100 may be particularly useful for golfers, for enabling golfers to hang their hat 10 on a table 5 when sat in a clubhouse. As such, as shown in FIG. 2, the portable hat hanger 100 may enable the attachment of a golf ball marker 15 thereto. In some embodiments, the portable hat hanger 100 may be provided with the golf ball marker and/or the portable hat hanger 100 may be configured to receive existing golf ball markers.

Figure 3:
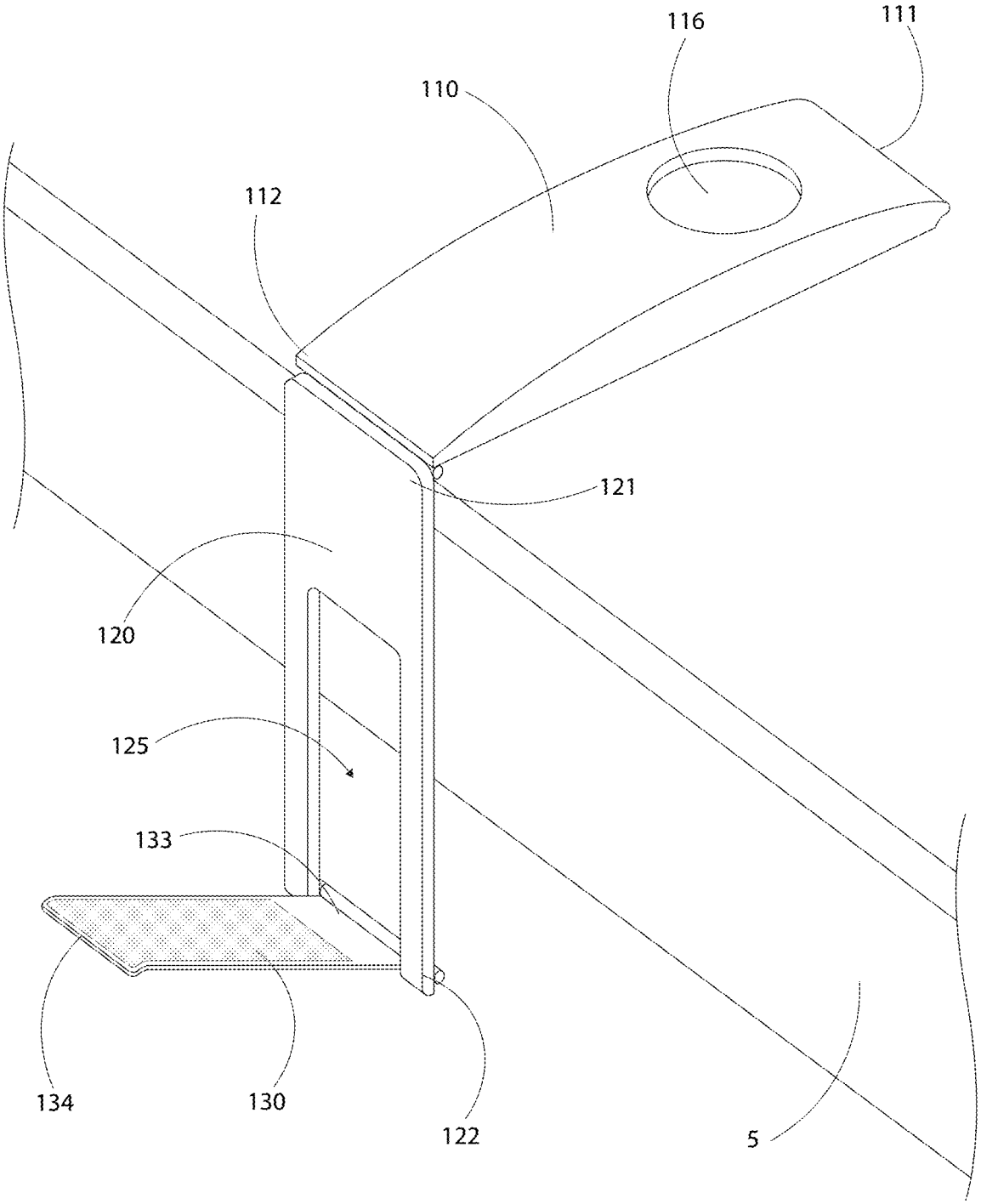
FIG. 3 is a close-up view of the portable hat hanger in an in-use position on a table and including a first portion holding the portable hat hanger on the table, a second portion pivotably attached to the first portion, and a hanger portion pivotably attached to the second portion and holding a hat thereon, according to an embodiment of the present disclosure.
Figure 4:
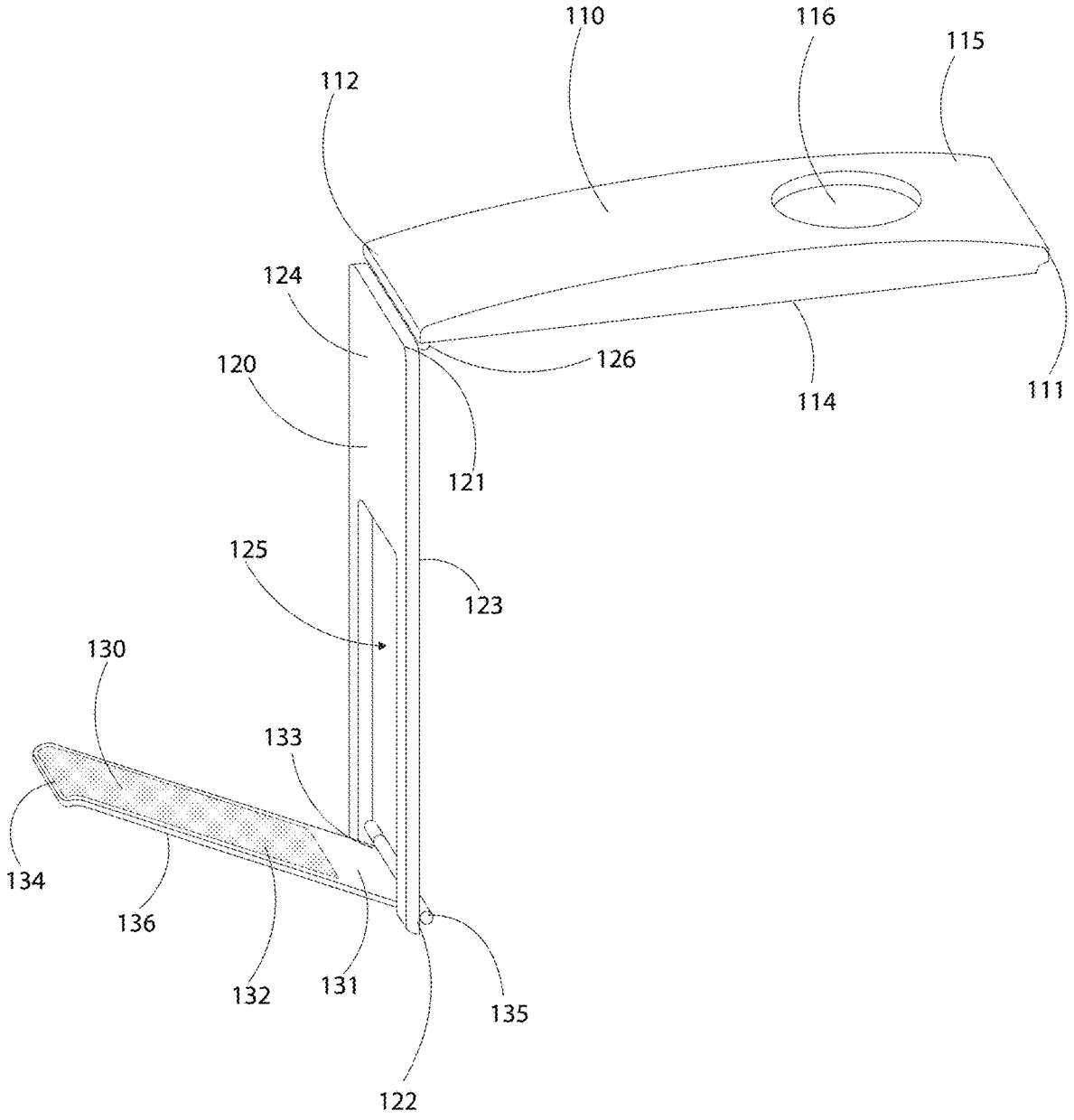
FIG. 4 is a side perspective view of the portable hat hanger in the in-use position, according to an embodiment of the present disclosure.
Figure 5:
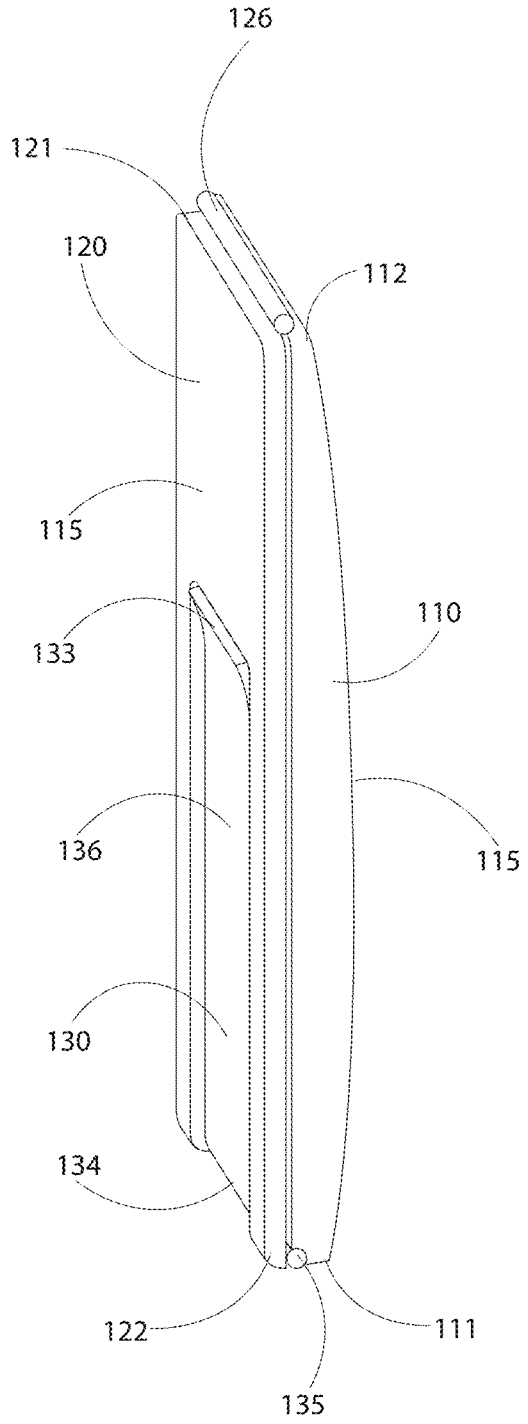
FIG. 5 is side perspective view of the portable hat hanger in a compact position, according to an embodiment of the present disclosure.

Referring more specifically to FIGS. 3-5, illustrating various perspective views of the portable hat hanger 100, according to one or more embodiments of the present disclosure. In particular, FIGS. 3-4 demonstrate perspective views of the portable hat hanger 100 being unfolded in an in-use position and FIG. 5 demonstrates a perspective view of the portable hat hanger 100 being folded and in a compact position. As shown in FIG. 5, when folded, the portable hat hanger 100 is compact and easily portable 5. In particular, the portable hat hanger 100 may be sized to be carried in a pocket of a user when folded.

As shown, the portable hat hanger 100 may include a first portion 110 (e.g., a top portion), a second portion 120 (e.g., a bottom portion) pivotably attached to the first portion 110 and a hanger portion 130 pivotably attached to the second portion 120. As above and as shown in FIG. 2, the portable hat hanger 100 may be configured to receive a golf ball marker 15. As such, in some embodiments, the first portion 110 may include a recess 116 for a golf ball marker 15. For example, the recess 116 may be disposed into an exterior surface 115 of the first portion 110. The recess 116 may include a slight depression or groove, enabling the user to press down on a leading edge of the golf ball marker 15, thereby lifting a rear (opposite) edge thereof and enabling the user to remove the golf ball marker 15 from the first portion 110.

The first portion 110 may include a proximal end 112 opposite a distal end 111; and the second portion 120 may further include a proximal end 121 opposite a distal end 122. The proximal ends 112, 121 of the first and second portions 110, 120, respectively, may be pivotably attached to together such that the first portion 110 and the second portion 120 are able to pivot between a folded position (FIG. 5) and an unfolded position (FIGS. 3-4). In particular, as shown in FIG. 5, the first portion 110 may be able to 'fold' over the second portion 120. To enable this, as shown in FIG. 4, the first portion 110 and the second portion 120 may be attached via a hinge 126.

The hanger portion 130 may be pivotably attached to the second portion 120 and able to pivot between a stowed position and a hanging position relative to the second portion 120. In particular, a first end 133 of the hanger portion 130 (opposite a second end 134 thereof) may be attached to a distal end 122 of the second portion 120, via a hinge 135. As shown in FIG. 2 in particular, in the hanging position the hanger portion 130 is able to hold, or hook, the hat 10 thereon.

In some embodiments, as shown here, the second portion 120 of the portable hat hanger 100 may include an elongated opening, defining a seat 125, having a size and shape equal to or at least similar to the hanger portion 130. As such, when the hanger portion 130 is in the stowed position, the hanger portion 130 is stowed within the seat 125 of the second portion 120. In particular, the hanger portion 130 may include an elongated rectangular shaft and as such, the seat 125 may include an elongated rectangular shape. In some examples, the seat 125 and the hanger portion 130 may each include (but are not limited to) a length of 2 inches and a width of 0.5 inches. When stowed in the seat 125, the hanger portion 130 may be flush with the second portion 120. Further, as shown in FIG. 4 in particular, the second end 134 of the hanger portion may include a curvature. This may enable easy gasping of the hanger portion 130 to move it out of the seat 125 and into the hanging position.

As also shown here, the first portion 110 and the second portion 120 may include elongated bodies. The first portion 110 and the second portion 120 may include substantially the same size and shape and thus may define two at least equal in length halves of the portable hat hanger 100. For example, the first and second portions 110, 120 may both include (but are not limited to) a length of 3 inches, a width of 1 inch and a depth of 0.5 inches.

Figure 6:
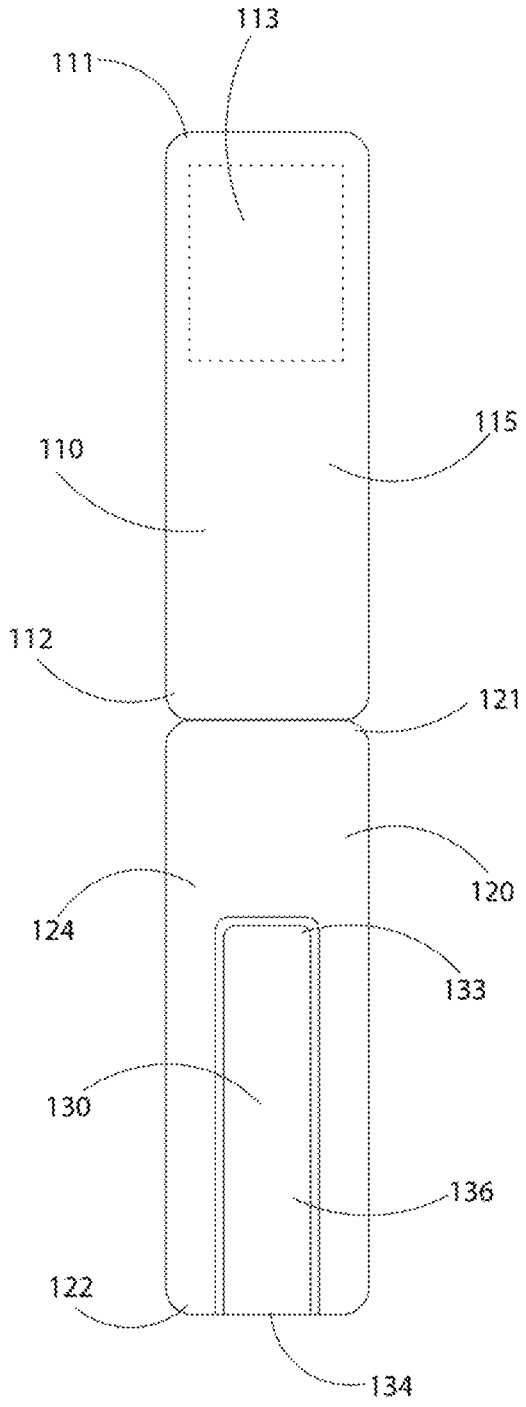
FIG. 6 is a rear view of the portable hat hanger illustrating the first and second portion in an unfolded position and the hanger portion in a stowed position, the first portion including a counterweight, according to an embodiment of the present disclosure.
Figure 7:
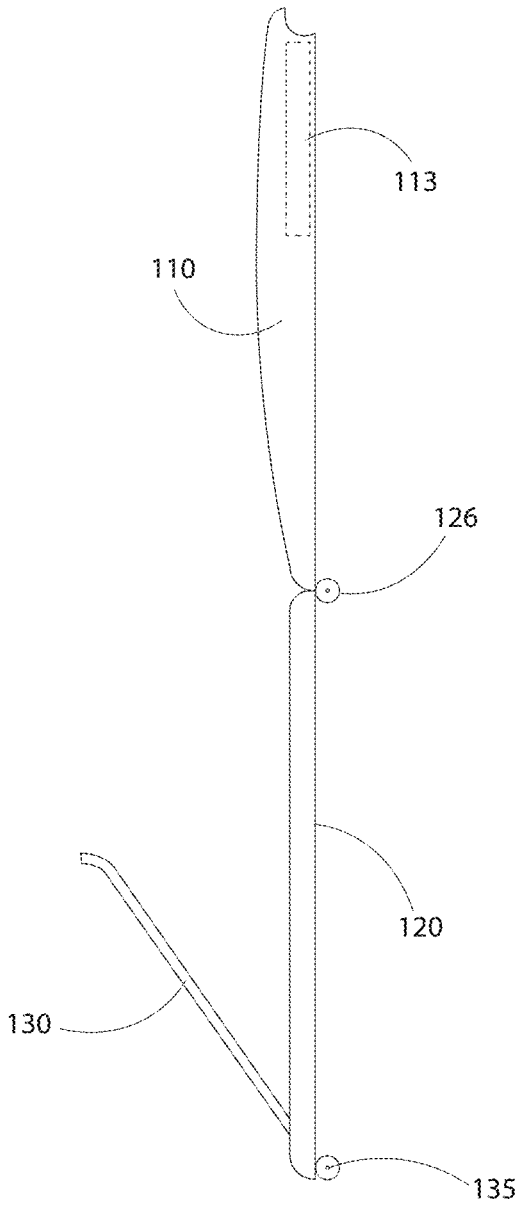
FIG. 7 is a side view of the portable hat hanger illustrating the hanger portion being in a hanging position and the first portion including the counterweight, according to an embodiment of the present disclosure.
Figure 8:
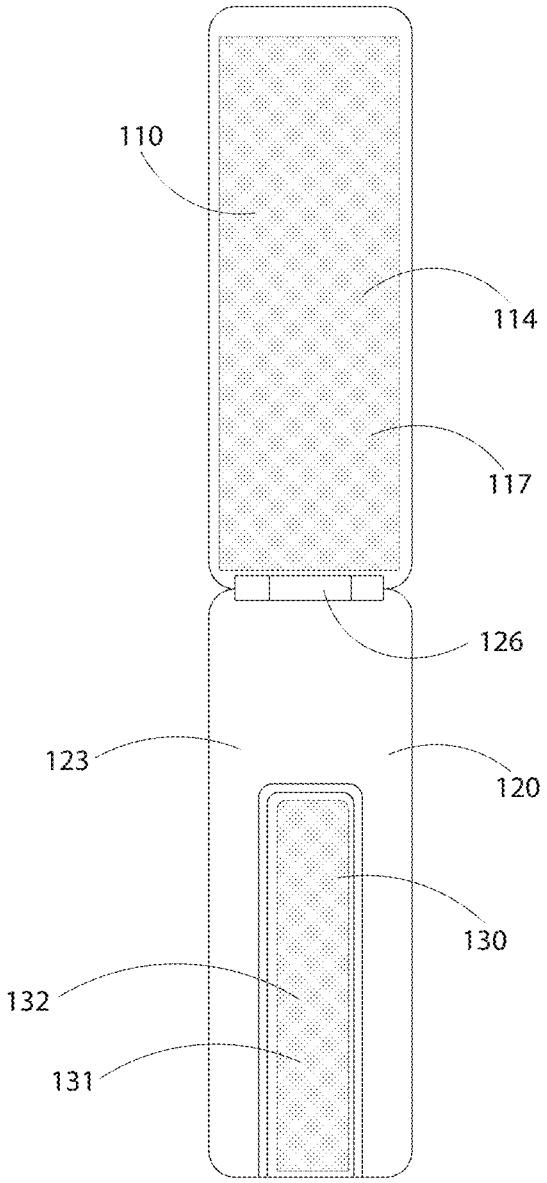
FIG. 8 is a front view of the portable hat hanger illustrating the first portion and the hanger portion including non-slip material, according to an embodiment of the present disclosure.

Referring now also to FIGS. 6-8, which demonstrate various views of the portable hat hanger 100, according to one or more embodiments of the present disclosure. In some embodiments, the second portion 120 may be able to pivot at least up to 90 degrees relative to the first portion 110. In other embodiments, the first portion 110 and second portion 120 may be able to pivot between 0-180 degrees relative each other. In particular, when folded, the first portion 110 and the second portion 120 may be oriented substantially 0 (zero) degrees relative each other, as measured from interior surfaces 114, 123 of both the first portion 110 and the second portion 120. When unfolded, the first portion 110 and the second portion 120 may be able to pivot as far as 180 degrees relative to each other, but at least up to 90 degrees.

Further, the hanger portion 130 may be pivotably attached to the second portion 120 and able to pivot at least up to 90 degrees relative to the second portion 120. In particular, the hanger portion 130 may be able to hold a hat 10 thereon when extended between 10-90 degrees relative to the second portion 120, as measured from an interior surface 131 of the hanger portion 130 (opposite an exterior surface 136 thereof) to an exterior surface 124 of the second portion 120. For example, as shown in FIG. 7 (and in FIG. 2), the hanger portion 130 may be oriented approximately 45-65 degrees relative to the second portion 120.

As further demonstrated in FIGS. 6-8, a counterweight 113 may be disposed within the first portion 110 and able to secure the portable hat hanger 100 to the horizontal surface (e.g., the table 5) and counteract a weight of a hat 10. The counterweight 113 is shown via broken lines here only to demonstrate that the counterweight 113 is disposed within the body of the first portion 110.

In some examples, the counterweight 113 may be configured to (but is not limited to) counteract a weight of between 50-100 grams. As such, the counterweight 113 may include (but is not limited to) a weight of between 50-100 grams. In other examples, the counterweight 113 may be configured to (but is not limited to) counteract a weight of between 50-80 grams. As such, the counterweight 113 may include (but is not limited to) a weight of between 50-80 grams. This may be particularly useful for lightweight hats, such as golf caps, as shown in FIG. 2. It should however be appreciated that these weights are given as examples to aid in understanding of the invention, and the counterweight 113 is not limited to counteracting or including a particular weight.

Further, in some embodiments, as shown in FIG. 8 in particular, the interior surface 114 of the first portion 110 may include a non-slip material 117, providing friction between the portable hat hanger 100 and the table 5 and preventing the portable hat hanger 100 from slipping off the table 5. For example, the non-slip material 117 may be liquid latex rubber. In addition, as again shown in FIG. 8 and also in FIGS. 3-4, an interior surface 131 of the hanger portion 130 may include a non-slip material 132, providing friction between the hanger portion 130 and the hat 10 and thus preventing the hat 10 from slipping off the portable hat hanger 100. For example, as above, the non-slip material 132 may also include a liquid latex rubber.

It should be appreciated that the texture used in these figures to indicate the non-slip materials 117, 132 are used for illustrative purposes only and are not meant to limit the invention in any way.

It should be noted that, under appropriate circumstances, considering such issues as design preference, user preferences, marketing preferences, cost, structural requirements, available materials, technological advances, etc., other methods are taught herein.

It should be understood by one of skill in the art that the disclosed invention is described here in a few exemplary embodiments of many. No particular terminology or description should be considered limiting on the disclosure or the scope of any claims issuing therefrom.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the relevant patent offices and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A portable hat hanger comprising:

a first portion and a second portion each including a distal end opposite a proximal end and an interior surface, the first portion and the second portion pivotably connected together at their proximal ends such that the first portion and the second portion are able to pivot relative to each other between a folded position and an unfolded position, the first portion including a counterweight disposed about the distal end thereof configured to secure the portable hat hanger about an edge of a horizontal surface in the unfolded position; and a hanger portion includes an elongated rectangular shaft, and a first end opposite a second end, the second end of the hanger portion includes a curvature, the hanger portion pivotably attached about the distal end of the second portion and able to pivot between a stowed position and a hanging position relative to the second portion, the hanging position enabling a hat to be held on the hanger portion and wherein the counterweight in the first portion counteracts a weight of the hat held on the hanger portion, the interior surface of the hanger portion includes a second non-slip material, wherein the second portion includes an elongated opening disposed therein, beginning at the distal end of the second portion and extending inwardly into the second portion, the elongated opening including a size and shape at least substantially equal to the hanger portion, and wherein the interior surface of the first portion includes a first non-slip material.

2. The portable hat hanger of claim 1, wherein the first portion and the second portion each include elongated bodies and define two generally equal in length halves of the portable hat hanger.

3. The portable hat hanger of claim 2, wherein the proximal end of the second portion is attached to the proximal end of the first portion via a first hinge.

4. The portable hat hanger of claim 3, wherein the second portion is able to pivot up to at least 90 degrees relative to the first portion.

5. The portable hat hanger of claim 3, wherein the first portion and second portion are able to pivot between 0 and 180 degrees relative each other.

6. The portable hat hanger of claim 5, wherein the folded position of the first portion and the second portion includes the first portion and the second portion being angled substantially 0 degrees relative each other, as measured from the interior surface of each of the first portion and the second portion.

7. The portable hat hanger of claim 5, wherein the unfolded position of the first portion and the second portion includes the first portion and the second portion being angled generally 90 degrees relative each other, as measured from the interior surface of each of the first portion and the second portion.

8. The portable hat hanger of claim 1, wherein the first end of the hanger portion is attached to a distal end of the second portion via a second hinge.

9. The portable hat hanger of claim 8, wherein the hanger portion is able to pivot up to at least 90 degrees relative to the second portion.

10. The portable hat hanger of claim 1, wherein the hanging position of the hanger portion includes the hanger portion being at an angle of between 10 and 90 degrees relative to the second portion, as measured from an exterior surface of the second portion to an interior surface of the hanger portion.

11. The portable hat hanger of claim 1, wherein the first non-slip material and the second non-slip material include liquid latex rubber.

12. The portable hat hanger of claim 1, wherein the first portion further includes a recess disposed within an exterior surface thereof, the recess being sized to receive a golf ball marker.

13. A portable hat hanger for a table, the portable hat hanger comprising:

a first portion and a second portion each including an elongated body and a distal end opposite a proximal end, the first portion and the second portion pivotably connected together at their proximal ends such that the first portion and the second portion are able to pivot relative to each other between a folded position, wherein the first portion and the second portion are angled substantially 0 degrees relative each other, and an unfolded position, wherein the first portion and the second portion are angled generally 90 degrees relative each other, the first portion including a counterweight disposed about the distal end thereof, and a first non-slip material coupled to an interior surface thereof, each configured to secure the portable hat hanger about an edge of the table in the unfolded position; and a hanger portion pivotably attached to the distal end of the second portion and able to pivot between a stowed position and a hanging position relative to the second portion, the hanging position including the hanger portion being at an angle of between 10 and 90 degrees relative to the second portion, thereby enabling a hat to be hooked onto on the hanger portion, an interior surface of the hanger portion further including a second non-slip material for securing the hat to the hanger portion; and wherein the counterweight in the first portion counteracts a weight of the hat hooked onto the hanger portion.

14. The portable hat hanger of claim 13, wherein the first non-slip material and the second non-slip material include liquid latex rubber.

* * * * *